US005310316A

United States Patent [19]

Arbeus

[11] Patent Number: 5,310,316

[45] Date of Patent: May 10, 1994

[54] IMPELLER FOR A PROPELLER PUMP

[75] Inventor: Ulf Arbeus, Lidingo, Sweden

[73] Assignee: ITT Flygt AB, Solna, Sweden

[21] Appl. No.: 926,474

[22] Filed: Aug. 6, 1992

[30] Foreign Application Priority Data

Aug. 28, 1991 [SE] Sweden ..... 9102460

[51] Int. Cl.[5] ..... F04D 29/18

[52] U.S. Cl. ..... 416/188; 416/223 R

[58] Field of Search ..... 416/188, 223 R, 238, 416/242; 415/218.1, 219.1, 221

[56] References Cited

U.S. PATENT DOCUMENTS

| | | | |
|---|---|---|---|
| 1,600,654 | 9/1926 | Stodder | 416/238 |
| 1,706,359 | 3/1929 | Lieber | 416/188 |
| 1,762,124 | 6/1930 | Moody | 416/188 |
| 2,936,948 | 5/1960 | Eck | 415/218.1 |
| 3,023,709 | 3/1962 | Kondo | 416/223 R |
| 3,260,311 | 7/1966 | Kovats | 416/188 |
| 3,905,719 | 9/1975 | Minnich | 416/188 |
| 4,775,297 | 10/1988 | Bernauer | 416/223 R |

FOREIGN PATENT DOCUMENTS

| | | | |
|---|---|---|---|
| 337934 | 11/1926 | Belgium . | |
| 378677 | 7/1923 | Fed. Rep. of Germany | 416/223 R |
| 949899 | 9/1956 | Fed. Rep. of Germany | 416/188 |
| 115475 | 7/1984 | Japan | 416/223 R |
| 60-73094 | 4/1985 | Japan . | |
| 367265 | 2/1932 | United Kingdom . | |

*Primary Examiner*—Richard A. Bertsch
*Assistant Examiner*—James A. Larson
*Attorney, Agent, or Firm*—Menotti J. Lombardi

[57] ABSTRACT

The hub is conically formed, and the vanes attached thereto are given a substantially radial direction; consequently, the turning axes of the vanes are situated in the center of the vanes, substantially bisecting the center of the vane chords. The turning axes are perpendicular to the impeller shaft.

3 Claims, 3 Drawing Sheets

IMPELLER FOR A PROPELLER PUMP

BACKGROUND OF THE INVENTION

This invention pertains to pumps of the roto-dynamic type which employ impellers rotatable in a housing; they, generally, are either of the centrifugal or the axial-flow embodiments, and in particular to a novel impeller for such roto-dynamic or propeller-type pumps.

The centrifugal pump comprises an impeller which consists of a hub and at least one covering disc which carries a plurality of vanes; such are called open impellers. A closed impeller has two covering discs, with the vanes therebetween. In both cases liquid is drawn axially into the center of the impeller, and leaves the latter essentially in a tangential direction from the circumference of the impeller.

The axial-flow pump is of an open type, having a space between the vanes and the enclosing or surrounding housing. It differs from the centrifugal pump in that the liquid moves, essentially, in an axial direction through the pump. The tangentially-directed velocity vector which is obtained after the impeller is reduced in a number of guide vanes in the housing downstream of the impeller. Said guide vanes also normally serve as support elements in the housing structure.

When pumping waste water, and certain types of industrial-process water containing elongated fibers, the operation can be disturbed by rag shreds, fibers, etc., getting stuck onto the leading edges of the impeller vanes as well as on the guide vanes of the pump housing. The build-up thereof can dramatically decrease the efficiency of the pump. The result will normally be that the flow decreases and the power demand increases. One way to make the collected debris to leave the vanes is to let the impeller rotate in reverse, at certain intervals, but this is not a solution which recommends itself. Another way in which to diminish the likelihood of pump clogging by such debris is to incorporate a cutting means for comminuting the fibers etc., before they are ingested into the impeller. A device of this sort is shown in the Swedish patent No. 8205774-6. It has the disadvantage, however, that the cutting means quickly wears out and the clogging problems may become worse.

It is also known to design the vanes with backward swept leading edges in the flow direction, whereby the pollutions more easily glide off. An example is shown in the European published publication 237 921. This impeller has however a design which deteriorates the cavitation abilities.

Most propeller pumps on the market today are designed with a hub of a spherical shape provided with vanes which are turnable around axes mainly perpendicular to the direction of the rotation axis. This possibility to control the vanes means that a wide range of flow capacity is covered with one and the same pump. The spherical form also means that a vane may be turned into different angles while keeping the same slot towards the hub thus minimizing losses in the slot.

When designing an axial-flow pump it is often desired to keep a high specific rotation speed, i.e., a maximum flow should be obtained at a given speed. This means that the inlet area, the area between the hub and the wall of the housing, should be maximized. As the outer diameter of the housing is limited because of the cavitation problem, there is only a decrease of the diameter of the hub left.

Spherical formed hubs always mean problems of a flow technical art when the radius is shortened as the possible geometric length of the connection between the hub and the vanes also shortens. If an acceptable efficiency should be obtained, said connection length must never be less than a certain value and this means that there must be a compromise between the two goals: large flow and high efficiency, respectively.

For pump impellers where the vanes should be adjustable, it is desired that the entire vane is kept collected around the axis around which the vane is turned when adjusted. Then a minimal axial translation movement occurs during rotation and a flow effective change of angles for all profile sections (chords) is obtained. If, for a conventional propeller pump having a relatively high specific rotation speed, the profile sections that form the vane are swept backwards in such a way that the leading edges become self-cleaning, the performance of the pump will be almost unchanged, provided that the angle is kept. However, short root connections between the hub and the vanes means that the trailing edge, also, will be markedly swept backwards; consequently, there is no optimum turning axis. The swept impeller will, therefore, be less effective after turning to another angle than would be the non-swept impeller. The aforesaid means that it is impossible to design a turnable and swept vane having an optimum performance, if a spherically-formed hub is used.

In order to have a vane which is sufficiently collected around its turning axis, and simultaneously is swept backwards, it is a known practice to shorten the chord lengths in the direction of the periphery of the vane. This limits the backward sweep of the trailing edge of the vane. The effect of this, however, is that the cavitation abilities deteriorate.

The spherically-formed hub could be avoided by molding the hub and vanes in one, single piece. Such, however, does not give the same flexibility and is expensive.

SUMMARY OF THE INVENTION

It is an object of this invention to set forth a solution for the aforenoted problems by disclosing an improved impeller for a propeller pump.

Particularly, it is an object of this invention to set forth an impeller for a propeller pump, comprising a hub; and a plurality of vanes turnably attached to said hub; wherein said vanes of said plurality thereof have backwards-swept leading edges; said hub has a cross-section which conically increases in the flow direction of said impeller; said vanes have tips which define a rotary circumference of the impeller; said vanes have chords of a given length which is undiminished towards said circumference; each said vane having a turning axis which substantially bisects the center of its chord; said leading edges of said vanes, measured from said circumference to said axes, each encompass a given distance; and said vanes have trailing edges which, measured from said circumference to said axes, each encompass a distance which is not more than eleven percent greater than said given distance.

BRIEF DESCRIPTION OF THE DRAWINGS

Further objects of this invention, as well as the novel features thereof, will become apparent by reference to the following description, taken in conjunction with the accompanying figures, in which.

DESCRIPTION OF THE PREFERRED EMBODIMENT

Figure 1:
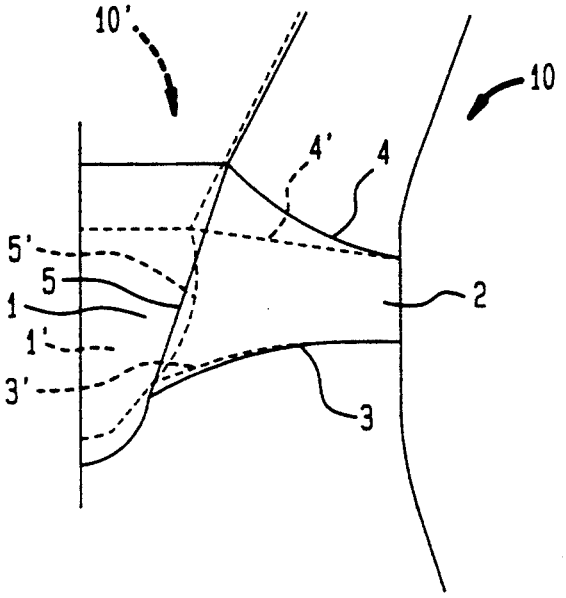
FIG. 1 is a depiction of half of hubs and a vane for each, in a radial view, of a known impeller and the improved impeller according to an embodiment thereof, the known impeller being shown in broken lines, and the inventive impeller in full lines.
Figure 2:
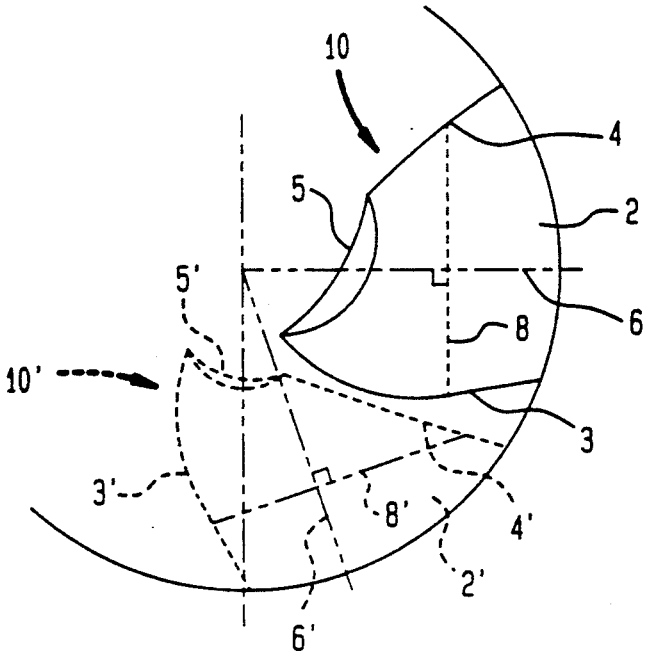
FIG. 2 is an axial view, again of a known impeller vane, and a vane according to a teaching of the invention, the former being in broken lines, and the latter in full lines.
Figure 3:
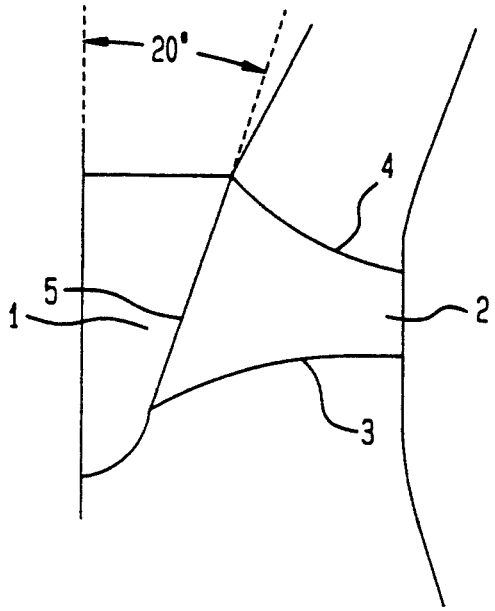
FIGS. 3 and 4 correspond to FIGS. 1 and 2, respectively, in which, however, for clarity of understanding, the known impeller components are omitted.
Figure 4:
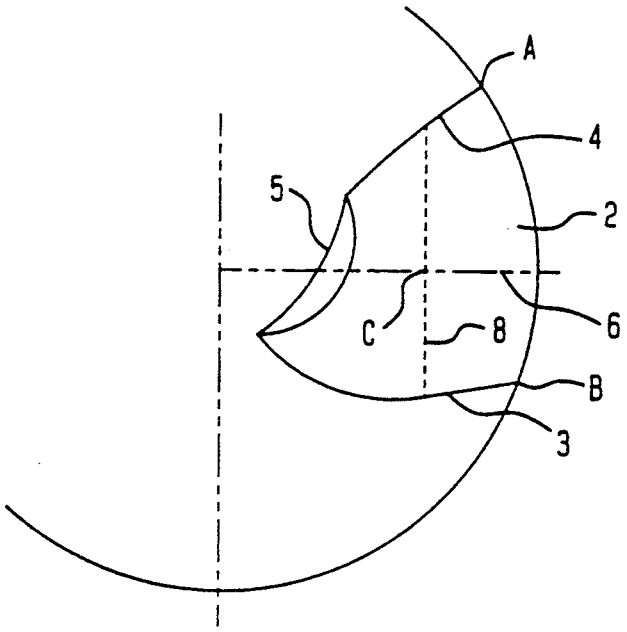
Figure 5:
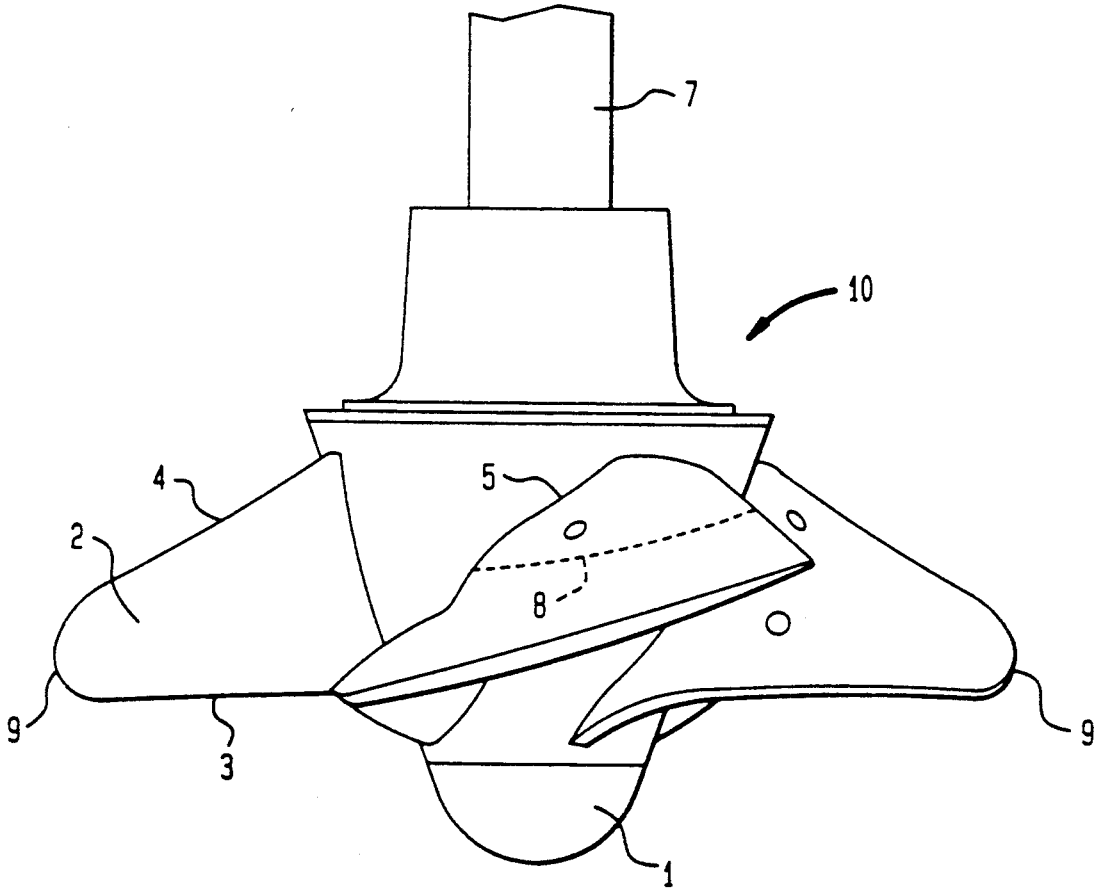
FIG. 5 shows an impeller, according to an embodiment of the invention, in a side view thereof.

The novel impeller 10, according to a preferred embodiment thereof, comprises a hub 1 and an impeller vane 2 joined thereto. The vane 2 has a leading edge 3 and a trailing edge 4. The vane is joined to the hub 1 by the root 5, and the vane has a turning axis 6. The propeller 10 has a shaft 7 coupled thereto. A chord 8 of the novel vane 2 is shown in FIGS. 2 and 4. Similar, primed index numbers, in FIGS. 1 and 2 denote like structure and features of the known impeller 10'. By study of FIGS. 1 and 2, it can be seen that the leading edges 3 and 3' of the novel impeller 10 and the known impeller 10' are almost in correspondence. However, a significant difference can be seen in the trailing edges 4 and 4', respectively. This is due to the use of a conical hub 1. As can be appreciated, in the comparison, a considerably wider area of vane 2, in the direction towards the root 5, is obtained by the employment of the conically-formed hub 1. The trailing edge 4 is not swept backwards to the same extent. Consequently, the axis 6, around which the vane 2 is turned at angle adjustment, will have a central position in the vane 2, and thus, good flowing conditions are maintained at different angles. In the conventional vane 2', on the other hand, the turning axis 6' is not central, and its performance deteriorates as soon as the angle is changed.

The fact that the hub 1 to root 5 connection is more extended, i.e., of greater length, than the corresponding connection for the conventional vane 2', and also more perpendicular to the turning axis 6, insures superior performance.

More particularly, in a preferred embodiment, the impeller 10 has tips 9 of its vanes 2 which describe a circle having a diameter of five hundred and seventy mm. The vanes 2 are attached to a hub 1 with a cone angle of twenty degrees of arc. The length of the vane 2, along the circumference "A" to "B" is three hundred mm., and the length of the root 5 is two hundred and fifty mm. The thickness of the vanes 2 vary from forty mm. at the root 5 to ten mm. at the tip 9. The direction of the turning axis 6 of the vane 2 is perpendicular to the impeller shaft 7. The turning axis 6, further, is as central as possible. That is, the distance between the axis 6 and the trailing edge 4 at "A" on the circumference is only eleven percent longer than the distance between the axis 6 and the leading edge 3 at "B" on the circumference. Too, the distance between the axis 6 and the trailing edge 4, at the root 5, is twenty percent shorter than the distance between the axis 6 and the leading edge 3. More, with reference to the center of gravity "C", the distances between the axis 6 and the two edges 3 and 4 are equal.

While I have described my invention, in connection with a specific embodiment thereof, it is to be clearly understood that this is done only by way of example, and not as a limitation to the scope of the invention as set forth in the objects thereof and in the appended claims.

I claim:

1. An impeller for a propeller pump for pumping waste water containing pollutants, comprising in combination:

a hub having a cone angle of twenty degrees of arc, and a straight impeller shaft joined to said hub;

a plurality of vanes attachable at arbitrary pitch angle to said hub;

said vanes of said plurality thereof have backwards-swept leading edges;

said hub has a cross-section which conically increases in the flow direction of said impeller;

said vanes have tips which define a rotary circumference of said impeller;

said vanes have chords of a given length which does not decrease towards said circumference;

each said vane having a center of gravity and a turning axis perpendicular to said shaft said turning axis substantially bisects the center of its chord at said center of gravity;

the distance between each leading edge of said vanes and the turning axis, at said circumference, encompasses a given distance;

the distance between each trailing edge of said vanes and the turning axis, at said circumference, encompasses another given distance which is not more than eleven percent greater than said given distance; and at said center of gravity, the lengths between said turning axis of each said vane and its leading and trailing edge are equal.

2. An impeller, according to claim 1, wherein:

each said vane has a root whereat it is attached to said hub;

the distance between each said leading edge of said vanes and said turning axis, at said root encompasses a prescribed distance; and the distance between each said trailing edge of said vanes and said turning axis, at said root encompasses another prescribed distance which is approximately twenty percent less than said prescribed distance.

3. An impeller according to claim 2, wherein:

the distance between each leading edge and trailing edge of said vanes, along said circumference, is greater than the distance between each leading edge and trailing edge of said vanes, along said root; and each said vane has a given thickness at said root and a thickness at said tip, and said given thickness is not less than four times said thickness.

* * * * *